US010879626B1

(12) United States Patent
Mansour et al.

(10) Patent No.: US 10,879,626 B1
(45) Date of Patent: Dec. 29, 2020

(54) SEPARATION-BASED ANTENNA SIGNAL COMBINING TECHNIQUES

(71) Applicant: Sprint Communications Company L.P., Overland Park, KS (US)

(72) Inventors: Nagi A. Mansour, Arlington, VA (US); Noman M. Alam, Chantilly, VA (US); Akin Ozozlu, McLean, VA (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 16/589,659

(22) Filed: Oct. 1, 2019

(51) Int. Cl.
*H01Q 21/30* (2006.01)
*H01Q 1/24* (2006.01)

(52) U.S. Cl.
CPC ..... *H01Q 21/30* (2013.01); *H01Q 1/243* (2013.01)

(58) Field of Classification Search
CPC ..... H01Q 21/30; H01Q 1/24
USPC ..... 343/824
See application file for complete search history.

(56) References Cited

U.S. PATENT DOCUMENTS

2010/0315305 A1* 12/2010 Takisawa ..... H01Q 1/3275 343/824
2015/0380832 A1* 12/2015 Scott ..... H01Q 3/2635 343/824

* cited by examiner

*Primary Examiner* — Andrea Lindgren Baltzell

(57) ABSTRACT

Methods and systems are provided herein for combining antenna signals based at least in part on the physical separation distance between antennas. A computing device includes a first antenna. The first the antenna is configured to receive a first signal. The first antenna is one of a plurality of antennas in the computing device. A second antenna is configured to receive a second signal. The second antenna has more physical separation distance from the first antenna relative to any other antenna within the computing device. A combiner within the computing device is configured to combine the first signal and the second signal based on the second antenna having more physical separation distance from the first antenna relative to any other antenna.

20 Claims, 5 Drawing Sheets

SEPARATION-BASED ANTENNA SIGNAL COMBINING TECHNIQUES

SUMMARY

The present disclosure is directed, in part, to combining antenna signals based at least in part on the physical separation distance between antennas. For example, a mobile device may have four antennas. In some aspects, a first pair of signals received at a first pair of antennas within the mobile device that have the largest separation distance can be combined (e.g., via selection combining). A second pair of signals received at a second pair of antennas within the same mobile device that have the largest separation distance can also be combined. In this manner, signal performance (e.g., signal strength, signal quality, etc.) can be improved based at least in part because more physical separation between antennas results in less correlation. That is, the individual combining of signals that are less correlated results in better performance, as described in more detail herein.

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

BRIEF DESCRIPTION OF THE SEVERAL VIEWS OF THE DRAWINGS

Implementations of the present disclosure are described in detail below with reference to the attached drawing figures, wherein.

DETAILED DESCRIPTION

Figure 1:
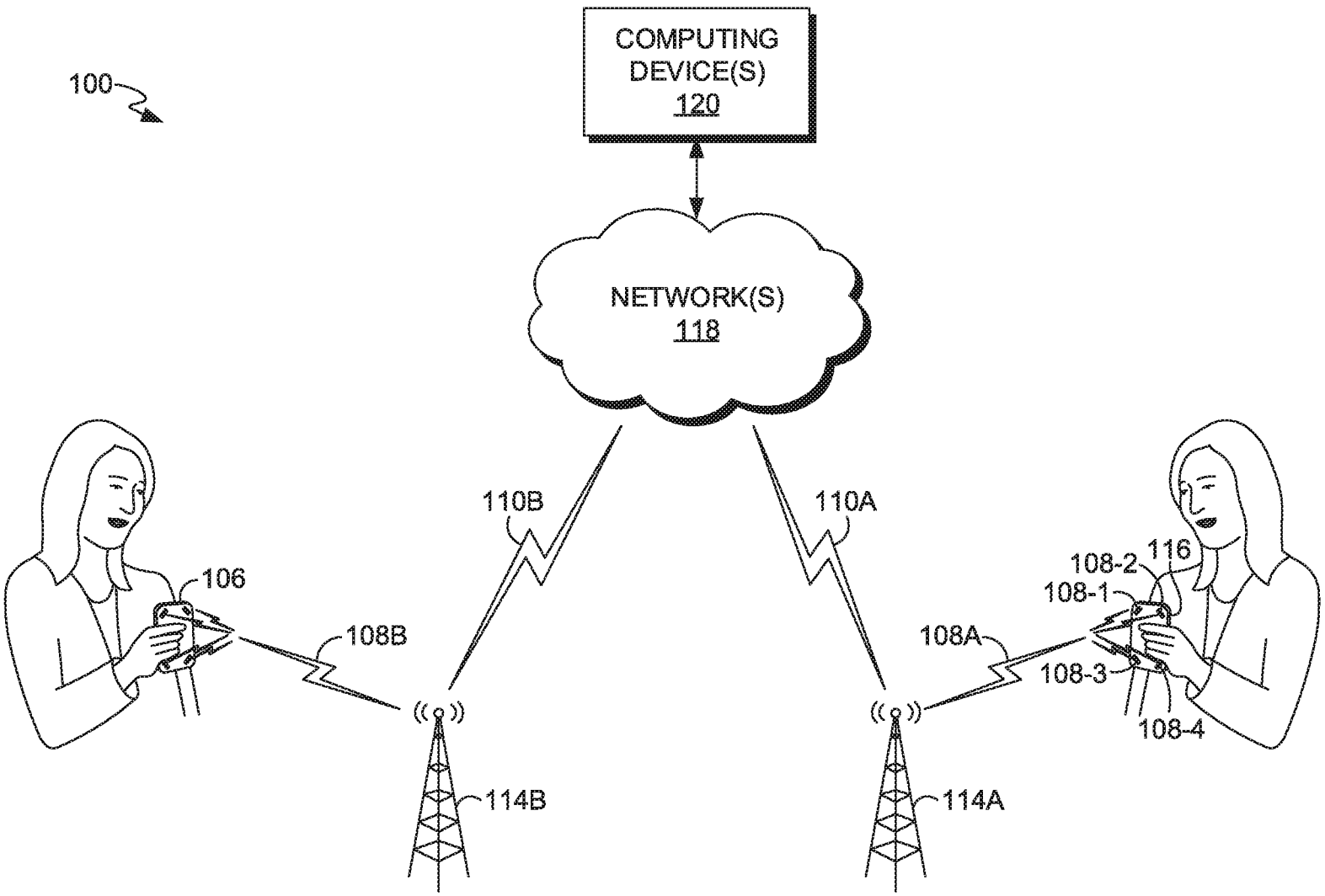
FIG. 1 depicts a diagram of an exemplary network environment suitable for use in implementations of the present disclosure.

The subject matter of embodiments of the invention is described with specificity herein to meet statutory requirements. However, the description itself is not intended to limit the scope of this patent. Rather, the inventors have contemplated that the claimed subject matter might be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Ideally, wireless communication between devices occurs via a line-of-sight path (i.e., waves travel in a direct path) between transmitter and receiver that represents clear spatial channel characteristics. However, in practice communications rarely occur via a line-of-site path because of physical barriers or other interference obstacles between transmitter and receiver. This can cause reflection, attenuation (or fading), phase shift, and/or distortion (e.g., due to noise) of the signals among other things, thereby reducing performance, such as signal strength. The presence of barriers or other interference obstacles in an environment associated with a transmitter and receiver create multiple paths that a transmitted signal traverses known as "multipath". As a result, a receiver (e.g., a mobile device antenna) or set of receivers obtain a superposition of multiple copies of the transmitted signal, each traversing a different path. Each signal copy often experiences differences in attenuation, delay, and/or phase shift while travelling from the source to the receiver. For example, between a cell tower (e.g., a transmitter) and a mobile phone antenna (e.g., a receiver), there may be multiple objects, such as mountains, tall trees, buildings, etc. This may cause multiple versions or copies of the same signal to take different paths and thus have differing characteristics (e.g., loss of a portion of the signal due to an obstacle). This can result in reduced signal performance.

In order to reduce multipath and its effects and because there is typically no clear line-of-sight path, multiple receiving points or antennas may be employed. In receive diversity, for example, several independent observation or copies of the same signal are combined into a single signal at the receiver or receivers. Employing multiple receiving points increases the likelihood that a better overall signal will be used for processing. This is because some receiving points may receive less multipath propagation effects compared to others. For example, a first signal may propagate relatively unobstructed to a first receiver. However, a second signal copy may bounce off of various buildings or other objects before it arrives at a second receiver, thereby causing attenuation, distortion, etc. When these two signals are combined, either the first signal is chosen as the output or otherwise considered in the final output. In this way, multiple independent paths for the signal are created and combined in some optimum way because different receiving points, which receive different versions of the signal may experience different interference values (e.g., different attenuation), are used.

Two or more signals received at receivers in space are generally correlated. "Correlation" indicates a value of similarity (e.g., a correlation coefficient) between signals. Typically, there is a correlation between the signals' gain and the angle of arrival. The more correlated signals are, the worse the performance of the signals typically is. Conversely, the less correlated signals are, the better the performance. This is because signals that have similar gains and similar angles of arrival indicates that the signals may have reflected or otherwise been subjected to the same interference. The correlation coefficient value generally depends on the physical separation between two or more points and the angular spread of incoming waves. Some embodiments of the present disclosure improve existing wireless communications and other mobile technologies by combining signals between pairs of antennas with the largest separation distance. In this way, there is less correlation between signals because there will likely be diversified gains given a greater angle of arrival between signals given the greater distances between antennas. This mitigates any risk that physical barriers or other interference may degrade or otherwise have a negative impact on signals. This is not only due to the fact that there are multiple employed antennas, such as in receiving diversity, but because the physical distance between individual antennas are relatively large at combining time, which is described in more detail herein.

There is currently no motivation to provide greater separation distances between antennas to use for combining. This is because smaller distances between antennas allows for improved functionality, such as better beamforming functionality. The smaller distances between antennas allows a more concentrated directional signal to be transmitted and received relative to larger distances between antennas. Further, there is less likelihood of interference between beamforming signals when the antennas are more concentrated. However, various embodiments of the present disclosure employ antenna configurations that have larger distances for the benefit of signal combining, which unexpectedly outweighs any disadvantages related to beamforming and other functionality.

Throughout the description of embodiments of the present invention, several acronyms and shorthand notations are used to aid the understanding of certain concepts pertaining to the associated methods, systems, and computer-readable media. These acronyms and shorthand notations are solely intended for the purpose of providing an easy methodology of communicating the ideas expressed herein and are in no way meant to limit the scope of the present invention.

Further, various technical terms are used throughout this description. An illustrative resource that fleshes out various aspects of these terms can be found in Newton's Telecom Dictionary, 31st Edition (2018).

Embodiments of this technology may be embodied as, among other things, a method, system, or computer-program product. Accordingly, the embodiments may take the form of a hardware embodiment, or an embodiment combining software and hardware. In one embodiment, the present invention takes the form of a computer-program product that includes computer-useable instructions embodied on one or more computer-readable media.

Computer-readable media include both volatile and nonvolatile media, removable and nonremovable media, and contemplate media readable by a database, a switch, and various other network devices. Network switches, routers, and related components are conventional in nature, as are means of communicating with the same. By way of example, and not limitation, computer-readable media comprise computer-storage media and communications media.

Computer-storage media, or machine-readable media, include media implemented in any method or technology for storing information. Examples of stored information include computer-useable instructions, data structures, program modules, and other data representations. Computer-storage media include, but are not limited to RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These memory components can store data momentarily, temporarily, or permanently.

Communications media typically store computer-useable instructions—including data structures and program modules—in a modulated data signal. The term "modulated data signal" refers to a propagated signal that has one or more of its characteristics set or changed to encode information in the signal. Communications media include any information-delivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

Turning now to the figures, FIG. 1 depicts an illustrative operating environment, referenced generally by the numeral 100. The illustrative operating environment 100 enables efficient signal combining based on separation between antennas. The illustrative operating environment 100 shown in FIG. 1 is merely an example of one suitable operating environment and is not intended to suggest any limitation as to the scope of use or functionality of embodiments of the present invention. For instance, the telecommunications network 118 illustrated in the example operating environment 100 may operate using a particular technology, such as GSM, CDMA, WAN, Wi-Fi, WiMAX, LTE, LTE Advanced, EVDO, HRPD, eHRPD, and the like. These technologies are listed for exemplary purposes only and are not meant to limit the scope of the present invention. In one embodiment, the operating environment 100 of FIG. 1 operates using LTE technology, but may also operate using other technologies as well. Additionally, the illustrative operating environment 100 may comprise one or more of the components illustrated in FIG. 1, but in some embodiments, the illustrative operating environment 100 includes one or more cell towers 114, a BTS, an RNC, gateways, etc. Not all components that make up a telecommunications network 118 are shown.

The illustrative operating environment 100 of FIG. 1 is shown user equipment or mobile devices 106 and 116 (also referred to herein as a computing devices) in communication with the telecommunications network 118 (although there may be fewer or more mobile devices). The mobile devices 106 and 116 may be in communication with the cell towers 114A and 114B via wireless-telecommunications link 108A and 108B (and more specifically through the branch signals 108-1, 108-2, 108-3, and 108-4 representing a least a partial copy of the link (e.g., signal) 108A, such as can occur via multipath). Wireless-telecommunications link 108A and 108B enables data to be wirelessly communicated (transmitted and/or received) between the mobile devices 106 and 116 and the cell towers 114A and 114B. This allows the mobile devices 106 and 116 to access the cellular network, Internet, and/or other network by way of, for example, the telecommunications network 118.

The cell towers 114A and 114B include or otherwise be associated with, a base station (e.g., as represented by the computing device(s) 120). In one embodiment, where LTE technology is employed, the base station is termed an eNodeB. Such a base station may be a large-coverage access component, in one embodiment. A large-coverage access component, compared to a small-coverage access component, is able to communicate data over a longer distance and is typically associated with a cell tower, such as cell tower 114A, while a small-coverage access component is only able to communicate over short distances. Examples of small-coverage access components include femto cells and pico cells. The cell towers 114A and 114B are in communication with the telecommunications network 118 by way of wireless-telecommunications links 110A and 110B. As used herein, the cell towers 114A and 114B and the base station refer to the equipment that facilitate wireless communication between user equipment, such as the mobile devices 106 and 116, and the telecommunications network 118.

In some embodiments, the telecommunications network 118 is communicatively coupled to the one or more computing devices 120. The one or more computing devices (e.g., a server), for example, may be located on the back-end of the telecommunications network 118 to facilitate transmissions received from the cell towers 114A and 114B and relayed to the one or more computing devices 120 via the telecommunications network 118 such that the one or more computing devices 120 may direct the transmissions to computing devices, such as the mobile devices 116 and 106. The one or more computing devices 120 may include software, hardware, and/or other components that facilitate voice calls, text messaging, Internet access, etc., over the telecommunications network 118. Further, the one or more computing devices 120 may monitor and optimize the telecommunications network 118 by monitoring data traffic and implementing data traffic management techniques.

As indicated in the operating environment 100, the mobile device 116 (and 106) receives multiple branch signals 108A-1, 108A-2, 108A-3, 10A8-4, and combines the signals, which can be based on separation between antennas within the mobile device 116, as described in more detail herein. In an example illustration, a user may engage in a text message or initiate a call from the mobile device 106. Responsively, the message may be communicated from the mobile device 106 to the cell tower 114B via the link 108B and from the cell tower 114B to the computing device(s) 120 via the link 110B. The message may then be processed and communicated from the computing device(s) 120 to the cell tower 114A via the link 110A and from the cell tower 114A to the mobile device 116. During this communication, there may be obstacles or other interference (e.g., mountains, signal interference) that causes branch signals (i.e., signals 108A-1, 108A-2, 108A-3, and 108A-4) or copies of the message sent (e.g., link 108A) by the mobile device 106 to be received by the mobile device 116. These branch signals may be combined using techniques described herein.

Figure 2B:
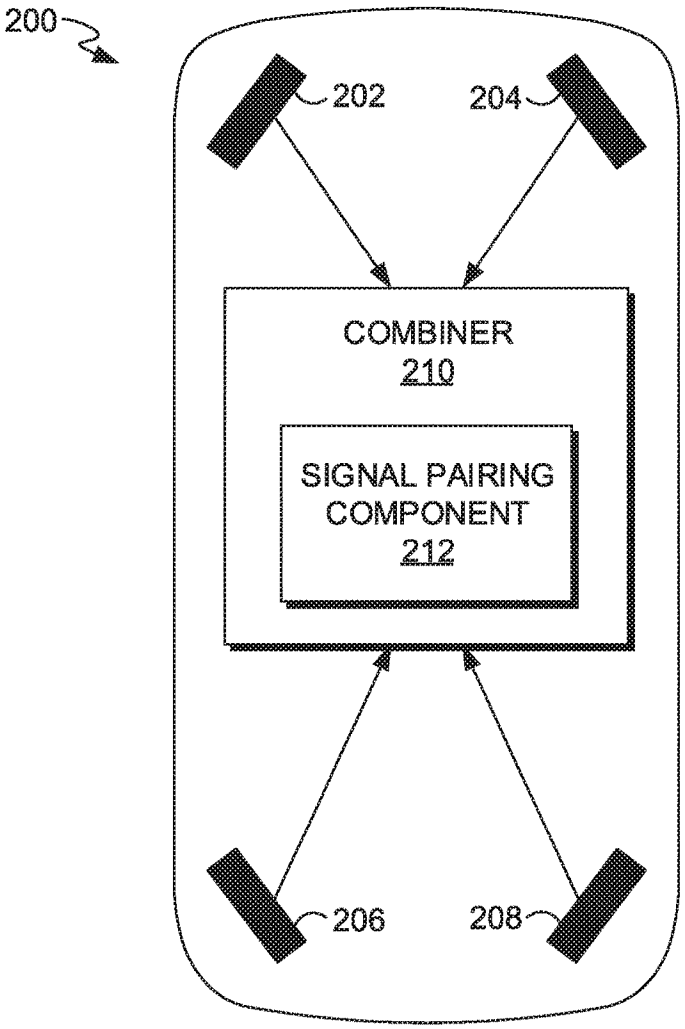
FIG. 2B is a block diagram illustrating the components that are responsible for combining signals obtained at the mobile device of FIG. 2A, in accordance with implementations of the present disclosure.
Figure 2A:
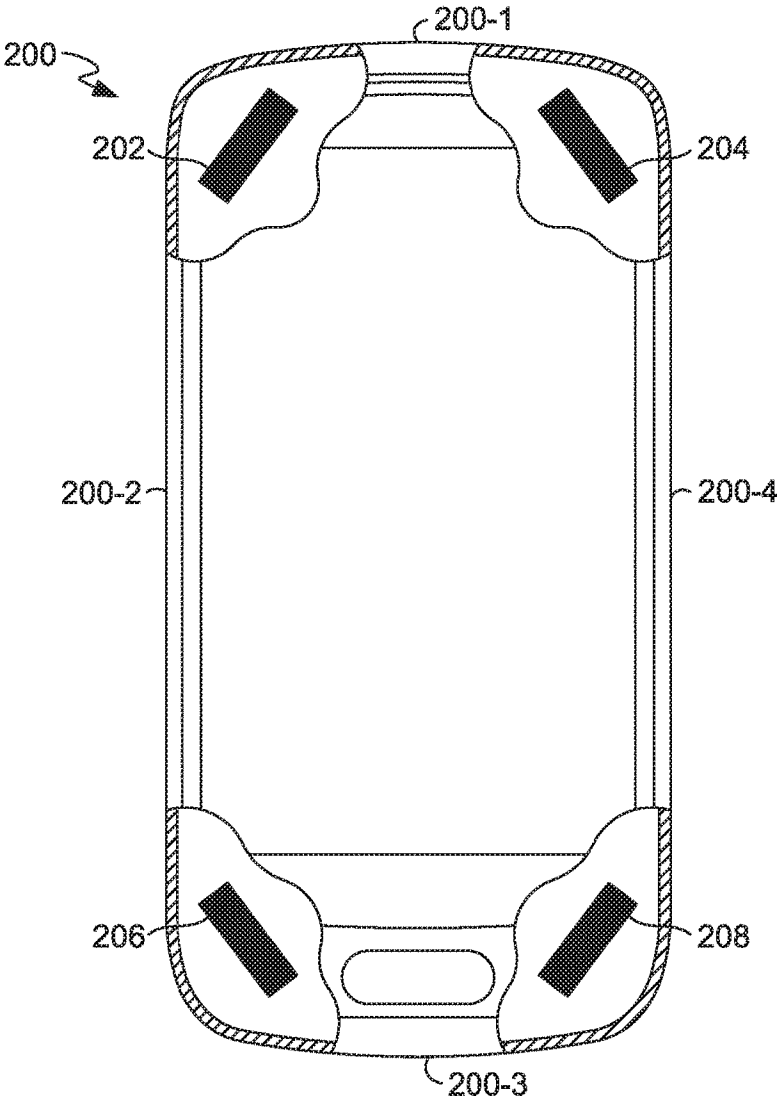
FIG. 2A is a schematic diagram illustrating an example placement of antennas within a mobile device, in accordance with implementations of the present disclosure.

FIG. 2A is a schematic diagram illustrating an example placement of antennas within a mobile device 200 (e.g., a smart phone) or other computing device, according to some embodiments. Although the mobile device 200 is illustrated in a specific hardware layout with a specific quantity of antennas in a particular orientation, it is understood that this is representative only and that any suitable configurations may exist. For example, there may be fewer or more antennas that the antennas 202, 204, 206, and 208. Further, in some embodiments, these antennas may be oriented in any suitable orientation so long as they are suitably separated for combining, as described herein. In some embodiments, the mobile device 200 represents the computing device 116 and/or 102 of FIG. 1.

The mobile device 200 includes the antennas 202, 204, 206, and 208, which each represent a discrete antenna unit (e.g., a first antenna, a second antenna, a third, antenna, and a fourth antenna). The mobile device 200 thus illustrates 4 antennas which are substantially near a respective corner of the mobile device 200. Typical mobile devices contain 1 or 2 antennas with a separation distance of $\lambda/2$ but more antennas (e.g., 4) with greater separation are used herein for signal combining purposes, as described in more detail below. These antennas are each individual interfaces between radio waves or signals propagating through space and electric currents moving in conductors that are used with a transmitter and/or a receiver. Typically, these antennas are conductors that transmit and/or receive electromagnetic waves and can be used to convert signals (e.g., RF signal) into alternating current (e.g., upon receiving of the signal) for processing by a processor or convert alternating current into signals (e.g., in preparation to transmit a signal). In some embodiments, each antenna or antenna unit are connected to their own transmitter and/or receiver.

The mobile device 200 includes a first side surface 200-2, a second side surface 200-4, a top surface 200-1, and a bottom surface 200-3. The mobile device 200 of FIG. 2A illustrates that the antenna 202 is placed or built in a vicinity (e.g., between 0.3 and 1.5 cm) of where the first side surface 200-2 and the top surface 200-1 meet. For example, the antenna 202 can be placed within the mobile device 200 about 0.4 cm away from the corner (i.e., where the first side surface 200-2 and the top surface 200-1 meet) on chip. The antenna 204 is likewise placed in a vicinity (e.g., between 0.3 and 1.5 cm) of where the second side surface 200-4 and the top surface 200-1 meet. For example, the antenna 204 can be placed within the mobile device 200 about 1 cm away from another corner (i.e., where the second side surface 200-4 and the top surface 200-1 meet) of the mobile phone 200. The antenna 206 is likewise placed in a vicinity (e.g., between 0.3 and 1.5 cm) of where the first side surface 200-2 and the bottom surface 200-3 meet. For example, the antenna 206 can be placed within the mobile device 200 about 0.8 cm away from yet another corner (i.e., where the first side surface 200-2 and the bottom surface 200-3 meet) of the mobile phone 200. The antenna 208 is likewise place in a vicinity (e.g., between 0.3 and 1.5 cm) of where the second side surface 200-4 and the bottom surface 200-3 meet. For example, the antenna 208 can be placed within the mobile device 200 about 0.5 cm away from another corner (i.e., where the second side surface 200-4 and the bottom surface 200-3 meet).

FIG. 2A illustrates that antennas are physically separated as much as possible in order to combine signals based on the physical separation distance between antennas, as described in more detail herein. This physical separation causes better performance as described above. In some embodiments, the antennas with the greatest separation distance are also equidistant from each other. For example, the distance (e.g., 4 inches) between the antenna 202 and the antenna 208 may also be the same distance (e.g., 4 inches) between the antenna 204 and the antenna 206. In this way, the antenna pairs that are used for combining are equidistant.

FIG. 2B is a block diagram illustrating the components that are responsible for combining signals obtained at the mobile device 200 of FIG. 2A. As illustrated in FIG. 2B, the mobile device 200 includes a combiner 210 that combines signals received at each of the antennas 202, 204, 206, and 208. The signal pairing component 212 combines pairs of signals or signals coming from pairs of antennas. The signal pairing component 212 combines pairs of signals whose corresponding antennas have the greatest separation distance. For example, relative to any of the antennas in the mobile device 200, the greatest separation distance (e.g., in inches, cm, etc.) from the antenna 202 is the antenna 208. That is, antenna 208 is the furthest away in distance from the antenna 202 (and vice versa) relative to the other antennas 204 and 206. Likewise, the antenna 204 is furthest away in distance from the antenna 206 relative to the other antennas 202 and 208. Accordingly, the signal pairing component 212 combines signals from these pairs of antennas that have the greatest separation distance relative to other antennas. For example, the signal pairing component 212 in various embodiments first combines a first signal received at the antenna 202 with a second signal received at the antenna 208 based on these antennas having more physical separation distance from each other relative to any of the other antennas 206 or 204. Likewise, the signal pairing component 212 can then combine a third signal received at the antenna 204 with a fourth signal received at the antenna 206 based on these antennas having more physical separation distance from each other relative to any of the other antennas within the mobile device 200. In various embodiments, the outputs of the combining in pairs can then be combined another time. For example, the combining of the signals between the antenna 202 and 208 may be a combined to a fifth signal. And the combining of the signals between the antenna 206 and 204 may be a combined sixth signal. Responsively, the fifth signal and the sixth signal can then be combined into a seventh signal, which is described in more detail below.

Figure 3B:
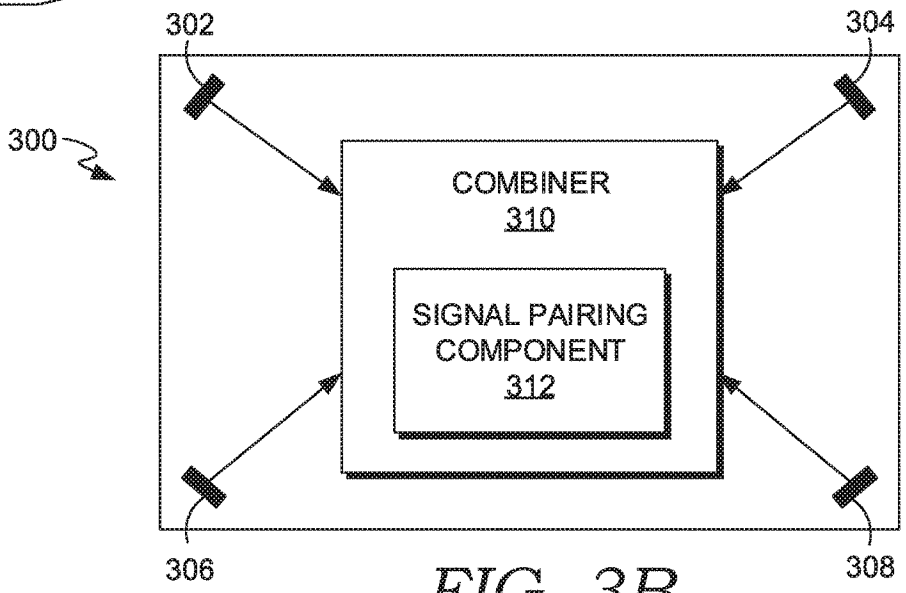
FIG. 3B is a block diagram illustrating the components that are responsible for combining signals obtained at the mobile device of FIG. 3A, in accordance with implementations of the present disclosure.
Figure 3A:
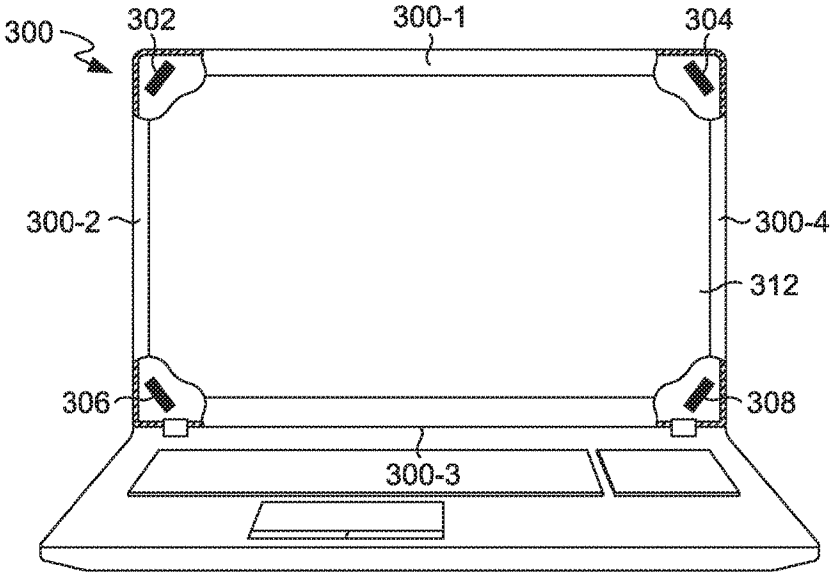
FIG. 3A is a schematic diagram illustrating an example placement of antennas within a computing device, in accordance with implementations of the present disclosure.

FIG. 3A is a schematic diagram illustrating an example placement of antennas within a computing device 300 (e.g., a laptop) or other computing device, according to some embodiments. Although the computing device 300 is illustrated in a specific hardware layout with a specific quantity of antennas in a particular orientation, it is understood that this is representative only and that any suitable configurations may exist. For example, there may be fewer or more antennas that the antennas 302, 304, 306, and 308. Further, in some embodiments, these antennas may be oriented in any suitable orientation so long as they are suitably separated for combining, as described herein. In some embodiments, the computing device 300 represents the computing device 116 and/or 102 of FIG. 1.

The computing device 300 includes the antennas 302, 304, 306, and 308, which each represent a discrete antenna unit (e.g., a first antenna, a second antenna, a third, antenna, and a fourth antenna). The computing device 300 thus illustrates 4 antennas which are substantially near a respective corner of the computing device 300 screen or display portion. Typical computing devices contain 1 or 2 antennas with a separation distance of $\lambda/2$ but more antennas (e.g., 4) with greater separation are used herein for signal combining purposes, as described in more detail below. These antennas are each individual interfaces between radio waves or signals propagating through space and electric currents moving in conductors that are used with a transmitter and/or a receiver. Typically, these antennas are conductors that transmit and/or receive electromagnetic waves and can be used to convert signals (e.g., RF signal) into alternating current (e.g., upon receiving of the signal) for processing by a processor or convert alternating current into signals (e.g., in preparation to transmit a signal). In some embodiments, each antenna or antenna unit are connected to their own transmitter and/or receiver.

The computing device 300 includes a first side surface 300-2, a second side surface 300-4, a top surface 300-1, and a bottom surface 300-3. The computing device 300 of FIG. 3A illustrates that the antenna 302 is placed or built in a vicinity (e.g., between 0.3 and 1.5 cm) of where the first side surface 300-2 and the top surface 300-1 meet. For example, the antenna 302 can be placed within the computing device 300 about 0.4 cm away from the corner (i.e., where the first side surface 300-2 and the top surface 300-1 meet) on chip. The antenna 304 is likewise placed in a vicinity (e.g., between 0.3 and 1.5 cm) of where the second side surface 300-4 and the top surface 300-1 meet. For example, the antenna 304 can be placed within the computing device 300 about 1 cm away from another corner (i.e., where the second side surface 300-4 and the top surface 300-1 meet) of the computing device 300. The antenna 306 is likewise placed in a vicinity (e.g., between 0.3 and 1.5 cm) of where the first side surface 300-2 and the bottom surface 300-3 meet. For example, the antenna 306 can be placed within the computing device 300 about 0.8 cm away from yet another corner (i.e., where the first side surface 300-2 and the bottom surface 300-3 meet) of the computing device 300. The antenna 308 is likewise place in a vicinity (e.g., between 0.3 and 1.5 cm) of where the second side surface 300-4 and the bottom surface 300-3 meet. For example, the antenna 308 can be placed within the computing device 300 about 0.5 cm away from another corner (i.e., where the second side surface 300-4 and the bottom surface 300-3 meet).

FIG. 3A illustrates that antennas are physically separated as much as possible in order to combine signals based on the physical separation distance between antennas, as described in more detail herein. This physical separation causes better performance as described above. In some embodiments, the antennas with the greatest separation distance are also equidistant from each other. For example, the distance (e.g., 4 inches) between the antenna 202 and the antenna 308 may also be the same distance (e.g., 4 inches) between the antenna 304 and the antenna 306. In this way, the antenna pairs that are used for combining are equidistant.

FIG. 3B is a block diagram illustrating the components that are responsible for combining signals obtained at the computing device 300 of FIG. 3A. As illustrated in FIG. 3B, the computing device 300 includes a combiner 310 that combines signals received at each of the antennas 302, 304, 306, and 308. The signal pairing component 312 combines pairs of signals or signals coming from pairs of antennas. The signal pairing component 312 combines pairs of signals whose corresponding antennas have the greatest separation distance. For example, relative to any of the antennas in the computing device 300, the greatest separation distance (e.g., in inches, cm, etc.) from the antenna 302 is the antenna 308. That is, antenna 308 is the furthest away in distance from the antenna 302 (and vice versa) relative to the other antennas 304 and 306. Likewise, the antenna 304 is furthest away in distance from the antenna 306 relative to the other antennas 302 and 308. Accordingly, the signal pairing component 312 combines signals from these pairs of antennas that have the greatest separation distance relative to other antennas. For example, the signal pairing component 312 in various embodiments first combines a first signal received at the antenna 302 with a second signal received at the antenna 308 based on these antennas having more physical separation distance from each other relative to any of the other antennas 306 or 304. Likewise, the signal pairing component 312 can then combine a third signal received at the antenna 304 with a fourth signal received at the antenna 306 based on these antennas having more physical separation distance from each other relative to any of the other antennas within the computing device 300. In various embodiments, the outputs of the combining in pairs can then be combined another time. For example, the combining of the signals between the antenna 302 and 308 may be a combined to a fifth signal. And the combining of the signals between the antenna 306 and 304 may be a combined sixth signal. Responsively, the fifth signal and the sixth signal can then be combined into a seventh signal, which is described in more detail below.

Figure 4:
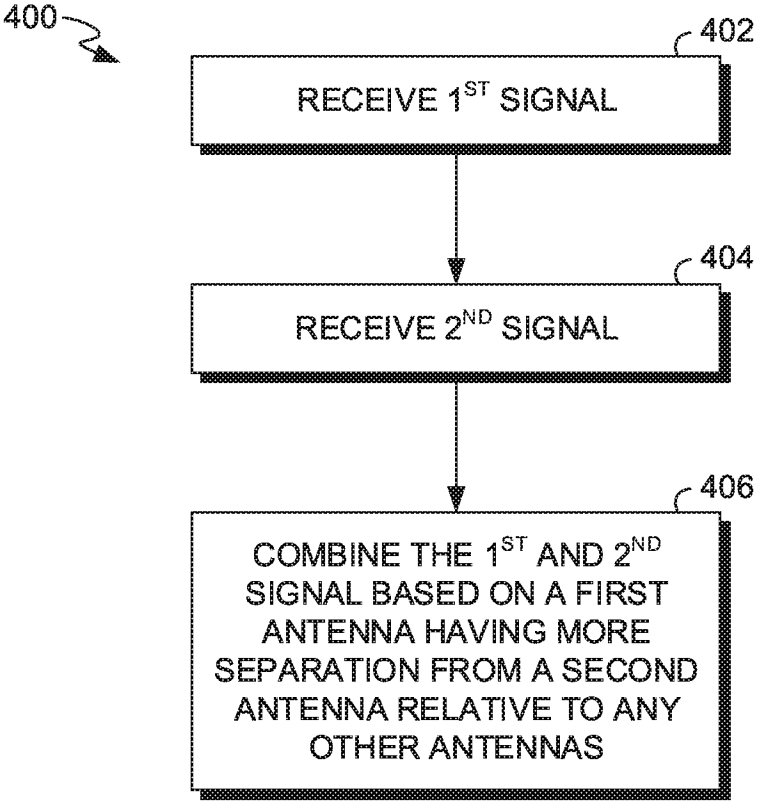
FIG. 4 is a flow diagram of an example process for combining signals based at least in part on separation distances between antennas, in accordance with implementations of the present disclosure.

FIG. 4 is a flow diagram of an example process 400 for combining signals based at least in part on separation distances between antennas, according to particular embodiments. The process 400 (and/or any of the functionality described herein (e.g., process 500)) may be performed by processing logic that comprises hardware (e.g., circuitry, dedicated logic, programmable logic, microcode, etc.), software (e.g., instructions run on a processor to perform hardware simulation), firmware, or a combination thereof. Although particular blocks described in this disclosure are referenced in a particular order at a particular quantity, it is understood that any block may occur substantially parallel with or before or after any other block. Further, more (or fewer) blocks may exist than illustrated. Such added blocks may include blocks that embody any functionality described herein. The computer-implemented method, the system (that includes at least one computing device having at least one processor and at least one computer readable storage medium), and/or the computer program product as described herein may perform or be caused to perform the process 400 any other functionality described herein.

Per block 402 a first signal is received (e.g., by the antenna 202). In some embodiments, a first branch signal of the first signal is received over a wireless network (e.g., the network 118) at a first antenna of a computing device. The first antenna may be one of a plurality of antennas in the computing device that is configured to receive the first signal. A "branch signal" as described herein is a signal or electromagnetic (e.g., radio) wave that comprises a set of elements of a particular signal, such as the first signal received at block 402. For example, a branch signal can comprise a first set of element that are a copy or replica of at least a portion (e.g., wave or frequency characteristics at a particular phase and/or unit of time) of the first signal received at block 402. A "copy" or replica in some instances corresponds to a match of a least a portion of the first signal's wavelength and/or frequency characteristics values for one or more phases and/or units of time. In some embodiments, the first signal received at block 402 is a branch signal.

Per block 404, a second signal is received (e.g., by the antenna 204). In some embodiments, a second branch signal of the first signal received at block 402 is received over the wireless communications network at a second antenna of the computing device. In some instances, the second branch signal comprises a copy of at least a portion of the first set of elements of the first signal received at block 402. In various instances, the second antenna has more separation distance from the first antenna relative to any other antenna within the computing device and vice versa. For example, referring back to FIG. 2, the antenna 202 may receive the first signal and the antenna 208 may receive the second signal. The antenna with the greatest separation in distance from antenna 202 is antenna 208 and vice versa, which helps at combine time (block 406) as described in more detail below.

Per block 406, the first signal and the second signal are combined (e.g., by the combiner 210 of FIG. 2) based on a first antenna having more separation (e.g., in terms of distance between antennas) from a second antenna relative to any other antennas. In some embodiments, an indication may be obtained that the second antenna has more physical separation distance from the first antenna relative to any other antenna within the computing device. In various embodiments, this indication may occur at run time (i.e., at the time of the receiving and/or combining of signals) and/or before run time, such as programmable firmware that obtains this indication when the combining logic is developed or created. In some embodiments, based on the second antenna having more physical separation distance from the first antenna, the first branch signal and the second branch signal are combined into a second signal (e.g., an output signal). The second signal may be used for processing by one or more processors of the computing device (e.g., cause display of a text message within the computing device). In an illustrative example, referring back to FIG. 3B, based on the antenna 306 having more physical separation distance from the antenna 304 relative to the antennas 302 or 308, the branch signals received from antennas 302 and 308 are combined into a single signal.

In some embodiments, the second signal is one of: the first branch signal, the second branch signal, the first signal, or a new signal. For example, the first or second branch signal can be the output combining signal (e.g., the second signal) based on selection combining, which selects the branch signal with the largest SNR, as described in more detail herein. In another example, the new signal can be the output (e.g., the second signal) based on Maximum ratio combining, which linearly combines or weights each branch signal into an aggregated final sum, which may take on different characteristics than the individual branch signals, which is described in more detail herein. In yet another example, the first signal can be the output (e.g., the second signal) based on interference rejection combining, which regenerates a signal based on the estimated data from previous receptions, which is described in more detail herein.

In various embodiments, the particular combining algorithm at block 406 includes one or more of: maximum ratio combining, interference rejection combining, and selection combining. Selection combining selects the branch signal with the largest Signal-to-Noise Ratio (SNR) (or strongest signal) as the output for processing. SNR is often expressed in Decibels (dB). SNR indicates a level of signal power compared or relative to a level of noise power (e.g., signal level divided by noise level). In some embodiments, the weight of 1 is assigned to the strongest signal and 0 is assigned to all other signals, which means that the signal with the weight of 1 is selected as the output.

In an example illustration of how selection combining can work in accordance with embodiments of the present disclosure, reference is made back to FIG. 2B. Each branch signal that is received by each antenna is combined in pairs based on the separation distance between antennas, as described above. For example, the antenna 202 may receive a first signal with a first dB value and the antenna 208 may receive a second signal with a dB value larger than the first signal. Based both on the selection combining algorithm and the greatest separation distance occurring between antenna 202 and 208, the second signal (being larger in dB value) is selected. Likewise, the antenna 204 may receive a third signal with a 3rd dB value and the antenna 206 may receive a fourth signal with a dB value smaller than the third signal. Based both on the selection combining algorithm and the greatest separation distance occurring between antenna 206 and 204, the third signal is selected. Because the second and third signals have the higher dB values between largest separated antennas, then these signals are also compared to determine which dB value is the higher dB value. For example, the second signal may have a higher dB value than the third value. Accordingly, the second signal may be selected as the final output for further processing, such as executing a telephone call requests.

Maximum ratio combining (MRC) is the linearly combining or weighting of each branch signal into an aggregated final sum in order to maximize SNR or signal strength. Signals from each branch signal are weighted according to their signal-to-noise ratios, using their RMS (root mean squared) signal levels and noise variances, and then added together. The gain of each channel is made proportional to the RMS signal level and inversely proportional to the mean square noise level. Effectively, a weighted average of the received signals are obtained so that the SNR is $$\sum_{n=1}^{\infty}\left(a_n\cos\frac{n\pi x}{L}+b_n\sin\frac{n\pi x}{L}\right).$$

MRC essentially assigns weight according to each of the branch signal's SINR, that is, the signals are equalized before being summed. The output is the sum of the SNR at each element. In this way, MRC can restore a signal close to its original characteristics before being subject to fading or other obstacles. This is assumed because each branch signal may theoretically contain slightly different characteristics (e.g., because they are received at different angles and/or are subject to different fading characteristics). Accordingly, each characteristic or weight of each branch signal can be combined to form a better overall signal.

In an example illustration of how MRC can work in accordance with embodiments of the present disclosure, reference is made back to FIG. 2B. Each branch signal that is received by each antenna is combined in pairs based on the separation distance between antennas, as described above. For example, the antenna 202 may receive a first signal with a first MRC weight value and the antenna 208 may receive a second signal with a second MRC weight value that is different than the first MRC weight value. Based both on the MRC combining algorithm and the greatest separation distance occurring between antenna 202 and 208, the first MRC weight value and the second MRC weight value are combined (e.g., added to form MRC prime value 1). Likewise, the antenna 204 may receive a third signal with a third MRC weight value and the antenna 206 may receive a fourth signal with a fourth MRC weight value different than the third MRC weight value. Based both on the selection combining algorithm and the greatest separation distance occurring between antenna 206 and 204, the third MRC weight value and the fourth MRC weight value are combined (e.g., added to form MRC prime value 2). The MRC prime value 1 and MRC prime value 2 are then combined or added together to form MRC prime value 3, which may correspond to a signal that is more indicative of its line-of-sight path characteristics than any of the single branch signals alone.

Interference rejection combining (IRC) regenerates a signal based on the estimated data from previous receptions, emulates the distortion occurring from multi-path channels, and then subtracting all regenerated interfering signals from the received signals. Each channel can be estimated and a covariance matrix calculated. In various embodiments, the covariance matrix can be calculated in signal pairs corresponding to the antennas with the greatest separation distance (e.g., antenna 202 and antenna 208). Alternatively or additionally, the interference can be removed in signal pairs corresponding to the antennas with the greatest separation distance.

Figure 5:
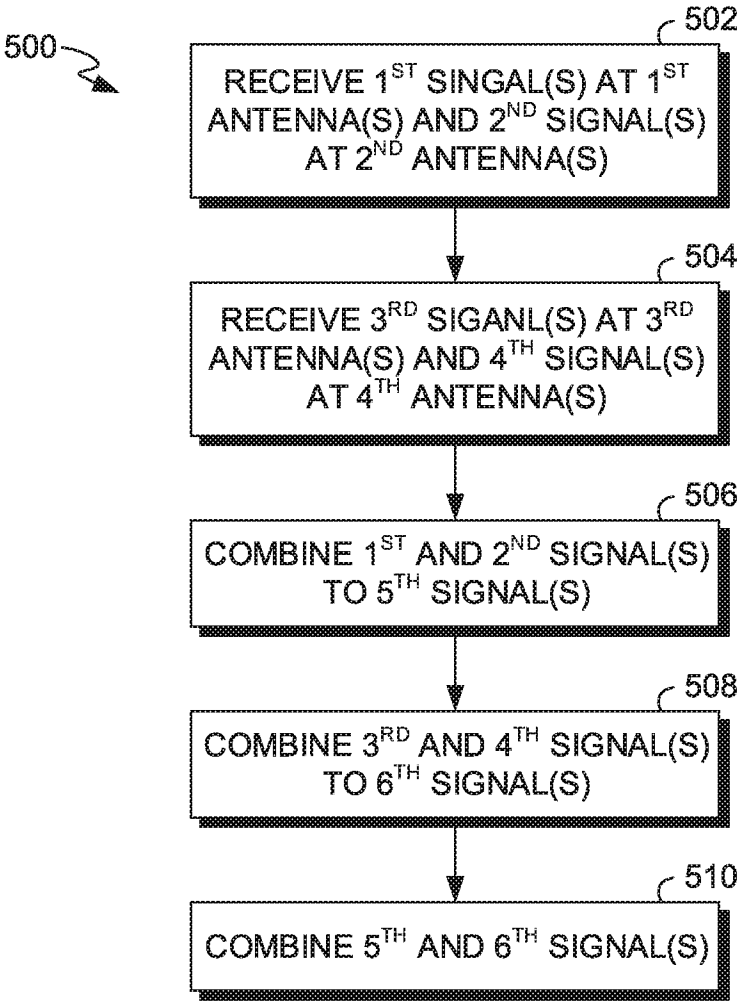
FIG. 5 is a flow diagram of an example process for combining signals from multiple antennas that have the greatest separation distance from each other, in accordance with implementations of the present disclosure.

FIG. 5 is a flow diagram of an example process 500 for combining signals from multiple antennas that have the greatest separation distance from each other, according to some embodiments. Per block 502, first signals and second signals are received at a first antenna(s) and a second antenna(s). In some embodiments, this corresponds to blocks 402 and 404 of FIG. 4. For example, a first antenna of a computing device is configured to receive a first branch signal of a first signal over a wireless network. The first antenna may be one of a plurality of antennas in the computing device. The first branch signal comprises a first set of elements of the first signal. A second antenna of the computing device is configured to receive a second branch signal of the first signal over the wireless communications network. The second branch signal comprises a copy of at least a portion of the first set of elements of the first signal. In an example illustration, referring back to FIG. 2B, the antenna 202 may receive a first branch signal and the antenna 208 may receive a second branch signal.

Per block 504, a third signal(s) is received at a third antenna(s), and a fourth signal(s) is received at a fourth antenna(s). For example, a third antenna of the computing device is (e.g., computing device 116) configured to receive a third branch signal of a first signal over a wireless communication network. The third branch signal may comprise another copy of another or same portion of a first set of elements of the first signal. Likewise, a fourth antenna of the computing device is configured to receive a fourth branch signal of the first signal over the wireless communications network. The fourth branch signal comprises a third copy of yet another portion (which could be the same portion) of the first set of elements of the first signal. Using the illustrative example above, the antenna 204 may receive the third branch signal and the antenna 206 may receive the fourth branch signal.

Per block 506, the first signal(s) and the second signal(s) are combined (e.g., by the combiner 210) to a fifth signal(s) or first output signal(s)). In various embodiments, the combining is based on the second antenna having more physical separation distance from the first antenna relative to any other antenna within the computing device. In various embodiments, the fifth signal(s) or output of the combining is the same or identical to one of the first, second, third, or fourth signals, such as would be the case in selection combining. In alternative embodiments, the fifth signal(s) has unique properties or elements compared to any of the other first, second, third, and fourth signals, which may be the case in such combining techniques as MRC.

In some embodiments, the first branch signal and the second branch signal are a first pair (e.g., received by antennas 202 and 208). And the third branch signal and the fourth branch signal are a second pair (e.g., received by antennas 204 and 206) and a combiner can select to combine the first pair prior to combining the second pair based any suitable optimization algorithm. For example, the first pair can be selected to combine first based on differing energy characteristics between the first pair and the second pair. In an illustrative example, the first pair can be selected to combine ahead of the second pair based on the pair together having higher SNR or dB levels, less interference, the corresponding antennas historically having better performance, etc. For example, a first and second antenna may have a pattern of continuously having better signal strength, gain, etc. compared to a third and fourth antenna. Accordingly, any signals received by the first and second antennas may be combined before signals are combined from the third and fourth antennas.

Per block 508, the third and fourth signal(s) are combined to form sixth signal(s). For example, based on the fourth antenna having more physical separation distance from the third antenna relative to the first antenna and the second antenna that have less physical separation distance from the third antenna, the third branch signal and the fourth branch signal can be combined into a sixth signal (e.g., second output signals). In various embodiments, the sixth signal(s) or output of the combining is the same or identical to one of the first, second, third, fourth, or fifth signals, such as would be the case in selection combining. In alternative embodiments, the sixth signal(s) has unique properties or elements compared to any of the other first, second, third, and fourth signals, which may be the case in such combining techniques as MRC. Using the illustrative example above, the third and fourth antenna may be the antenna 204 and the antenna 206 of FIG. 2B. Accordingly, branch signals received from these antennas can be combined based on these two antennas having the greatest separation distance from each other relative to the other antennas 202 and 208.

Per block 510, the fifth signal(s) and the sixth signal(s) are combined (e.g., by the combiner 210). In response to the combining of the first branch signal and the second branch signal and the combining of the third branch signal and the fourth branch signal to obtain the fifth and sixth signals, these signals can also be combined (e.g., to form a seventh signal or third output signals(s)). For example, using the illustration above, the first output of the combining of the signals received from antenna 202 and 208 can be combined with a second output of the combining of the signals received from the antenna 204 and 206 (e.g., to form a third output).

The implementations of the present disclosure may be described in the general context of computer code or machine-useable instructions, including computer-executable instructions such as program components, being executed by a computer or other machine, such as a personal data assistant or other handheld device. Generally, program components, including routines, programs, objects, components, data structures, and the like, refer to code that performs particular tasks or implements particular abstract data types. Implementations of the present disclosure may be practiced in a variety of system configurations, including handheld devices, consumer electronics, general-purpose computers, specialty computing devices, etc. Implementations of the present disclosure may also be practiced in distributed computing environments where tasks are performed by remote-processing devices that are linked through a communications network.

Figure 6:
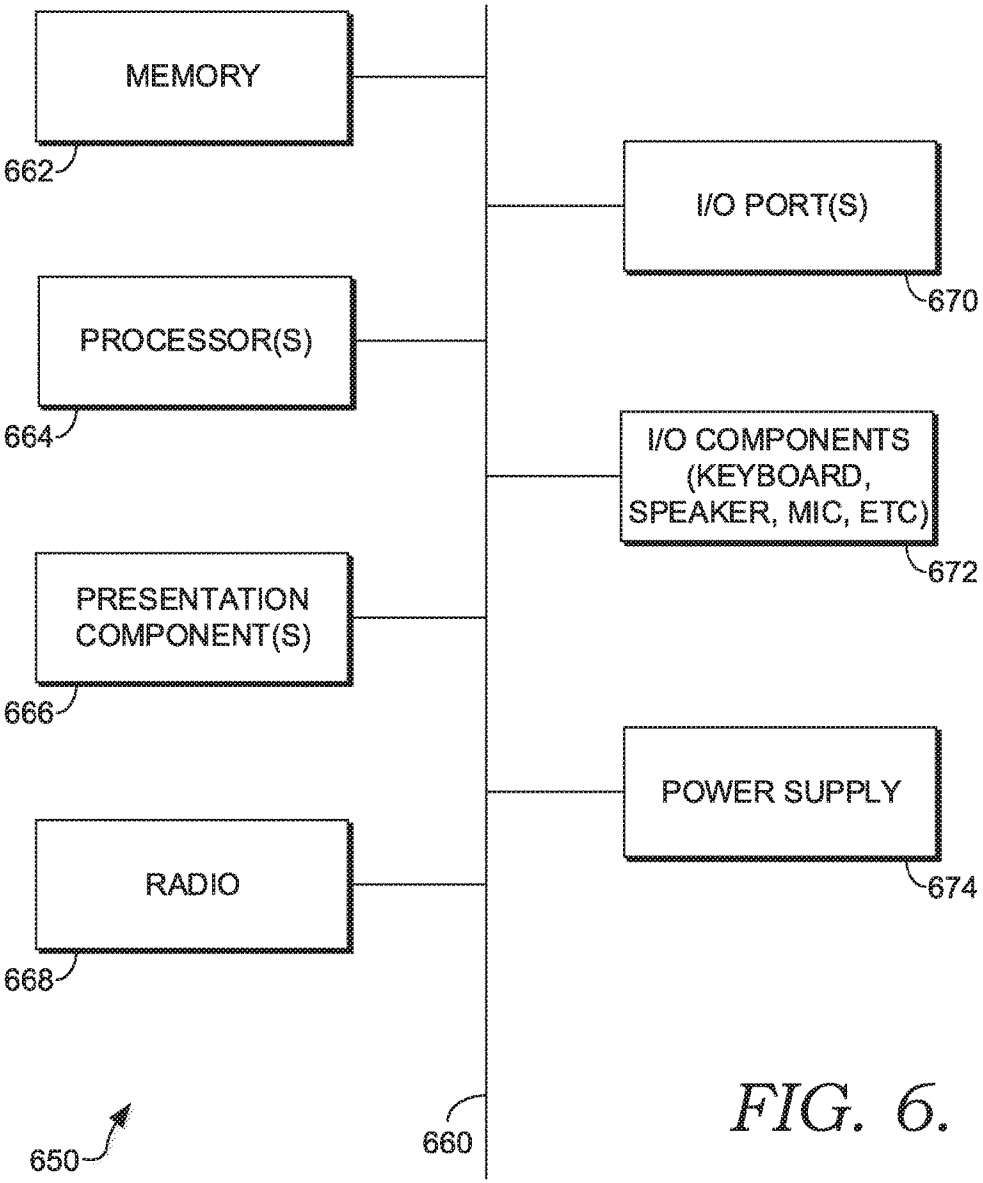
FIG. 6 is a block diagram of an example computing device suitable for use in implementations of the present disclosure.

With continued reference to FIG. 6, computing device 650 includes bus 660 that directly or indirectly couples the following devices: memory 662, one or more processors 664, one or more presentation components 666, input/output (I/O) ports 670, I/O components 672, and power supply 674. Bus 660 represents what may be one or more busses (such as an address bus, data bus, or combination thereof). Although the devices of FIG. 6 are shown with lines for the sake of clarity, in reality, delineating various components is not so clear, and metaphorically, the lines would more accurately be grey and fuzzy. For example, one may consider a presentation component such as a display device to be one of I/O components 672. Also, processors, such as one or more processors 664, have memory. The present disclosure hereof recognizes that such is the nature of the art, and reiterates that FIG. 6 is merely illustrative of an exemplary computing environment that can be used in connection with one or more implementations of the present disclosure. Distinction is not made between such categories as "workstation," "server," "laptop," "handheld device," etc., as all are contemplated within the scope of FIG. 6 and refer to "computer" or "computing device."

In some embodiments, the computing device 650 of FIG. 6 represents: the computing devices 106 and/or 116 of FIG. 1, the mobile devices of FIGS. 2A and 2B, and/or the computing devices of FIGS. 3A and 3B. In some embodiments, the computing device 650 performs the processes 400 and 500 with respect to FIG. 4 and FIG. 5 respectively.

Computing device 650 typically includes a variety of computer-readable media. Computer-readable media can be any available media that can be accessed by computing device 650 and includes both volatile and nonvolatile media, removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data.

Computer storage media includes RAM, ROM, EEPROM, flash memory or other memory technology, CD-ROM, digital versatile disks (DVD) or other optical disk storage, magnetic cassettes, magnetic tape, magnetic disk storage or other magnetic storage devices. Computer storage media does not comprise a propagated data signal.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 662 includes computer-storage media in the form of volatile and/or nonvolatile memory. Memory 662 may be removable, nonremovable, or a combination thereof. Exemplary memory includes solid-state memory, hard drives, optical-disc drives, etc. Computing device 650 includes one or more processors 664 that read data from various entities such as bus 660, memory 662 or I/O components 672. One or more presentation components 666 presents data indications to a person or other device. Exemplary one or more presentation components 666 include a display device, speaker, printing component, vibrating component, etc. I/O ports 5670 allow computing device 650 to be logically coupled to other devices including I/O components 672, some of which may be built in computing device 650. Illustrative I/O components 672 include a microphone, joystick, game pad, satellite dish, scanner, printer, wireless device, etc.

Radio 668 represents a radio that facilitates communication with a wireless telecommunications network. Illustrative wireless telecommunications technologies include CDMA, GPRS, TDMA, GSM, and the like. Radio 516 might additionally or alternatively facilitate other types of wireless communications including Wi-Fi, WiMAX, LTE, or other VoIP communications. As can be appreciated, in various embodiments, radio 668 can be configured to support multiple technologies and/or multiple radios can be utilized to support multiple technologies. A wireless telecommunications network might include an array of devices, which are not shown so as to not obscure more relevant aspects of the invention. Components such as a base station, a communications tower, or even access points (as well as other components) can provide wireless connectivity in some embodiments.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A computer-implemented method comprising:

receiving, at a first antenna of a computing device, a first branch signal of a first signal over a wireless communications network, the first antenna being one of a plurality of antennas in the computing device, the first branch signal comprises a first set of elements of the first signal;

receiving, at a second antenna of the computing device, a second branch signal of the first signal over the wireless communications network, the second branch signal comprises a copy of at least a portion of the first set of elements of the first signal;

obtaining an indication that the second antenna has more physical separation distance from the first antenna relative to any other antenna within the computing device; and based on the second antenna having more physical separation distance from the first antenna, combining the first branch signal and the second branch signal into a second signal, the second signal being used for processing by one or more processors of the computing device.

2. The method of claim 1, further comprising:

receiving, at a third antenna of the computing device, a third branch signal of the first signal over the wireless communications network, the third branch signal comprises another copy of another portion of the first set of elements of the first signal;

receiving, at a fourth antenna of the computing device, a fourth branch signal of the first signal over the wireless communications network; and based on the fourth antenna having more physical separation distance from the third antenna relative to the first antenna and the second antenna that have less physical separation distance from the third antenna, combining the third branch signal and the fourth branch signal into a third signal.

3. The method of claim 2, further comprising in response to the combining of the first branch signal and the second branch signal and the combining of the third branch signal and the fourth branch signal, combining the second signal and the third signal to a fourth signal.

4. The method of claim 2, wherein the first branch signal and the second branch signal are a first pair, and wherein the third branch signal and the fourth branch signal are a second pair, the method further comprising selecting to combine the first pair prior to combining the second pair based at least in part on differing energy characteristics between the first pair and the second pair.

5. The method of claim 1, wherein the second signal is one of: the first branch signal, the second branch signal, the first signal, or a new signal.

6. The method of claim 1, wherein the first antenna and the second antenna are equidistant from each other, and wherein a third antenna and a fourth antenna within the computing device are equidistant from each other.

7. The method of claim 1, wherein the computing device is a mobile device, the mobile device includes: the first antenna, the second antenna, a third antenna, and a fourth antenna each of which are substantially near a respective corner of the mobile device.

8. A computing device that includes one or more processors that are configured to perform a method, the method comprising:

receiving, at a first antenna of the computing device, a first branch signal of a first signal, the first antenna being one of a plurality of antennas in the computing device, the first branch signal comprises a first set of elements of the first signal;

receiving, at a second antenna of the computing device, a second branch signal of the first signal, the second branch signal comprises a copy of at least a portion of the first set of elements of the first signal, the second antenna having more physical separation distance from the first antenna relative to any other antenna within the computing device; and based on the second antenna having more physical separation distance from the first antenna, combining the first branch signal and the second branch signal into a first output signal.

9. The computing device of claim 8, the method further comprising:

receiving, at a third antenna of the computing device, a third branch signal of the first signal, the third branch signal comprises another copy of the portion or another portion of the first set of elements of the first signal;

receiving, at a fourth antenna of the computing device, a fourth branch signal of the first signal; and based on the fourth antenna having more physical separation distance from the third antenna relative to the first antenna and the second antenna that have less physical separation distance from the third antenna, combining the third branch signal and the fourth branch signal into a second output signal.

10. The computing device of claim 9, the method further comprising: in response to the combining of the first branch signal and the second branch signal and the combining of the third branch signal and the fourth branch signal, combining the second signal and the first output signal and the second output signal into a third output signal.

11. The computing device of claim 9, wherein the first branch signal and the second branch signal are a first pair, and wherein the third branch signal and the fourth branch signal are a second pair, the method further comprising selecting to combine the first pair prior to combining the second pair based at least in part on differing energy characteristics between the first pair and the second pair.

12. The computing device of claim 8, wherein the combining includes a technique of a group of techniques consisting of: maximum ratio combining, interference rejection combining, and selection combining.

13. The computing device of claim 8, wherein the first antenna and the second antenna are equidistant from each other, and wherein a third antenna and a fourth antenna within the computing device are equidistant from each other.

14. The computing device of claim 8, wherein the computing device is a mobile device, the mobile device includes: the first antenna, the second antenna, a third antenna, and a fourth antenna, wherein the computing device includes a first side surface, a second side surface, a top surface, and a bottom surface, and wherein the first antenna is placed in a vicinity of where the first side surface and the top surface meet, the second antenna is placed in a vicinity of where the second side surface and the top surface meet, the third antenna is placed in a vicinity of where the first side surface and the bottom surface meet, the fourth antenna is placed in a vicinity of where the second side surface and the bottom surface meet.

15. A system comprising:

a computing device;

a first antenna within the computing device, first the antenna configured to receive a first signal, the first antenna being one of a plurality of antennas in the computing device;

a second antenna within the computing device, the second antenna configured to receive a second signal, the second antenna having more physical separation distance from the first antenna relative to any other antenna within the computing device; and a combiner within the computing device, the combiner configured to combine the first signal and the second signal based on the second antenna having more physical separation distance from the first antenna relative to any other antenna.

16. The system of claim 15, further comprising:

a third antenna within the computing device, the third antenna configured to receive a third signal; and a fourth antenna within the computing device, the fourth antenna configured to receive a fourth signal, wherein the combiner is further configured to combine the third signal and the fourth signal.

17. The system of claim 16, wherein the combining of the first signal and the second signal has an output of a fifth signal, and wherein in response to the combining of the first signal and the second signal and the combining of the third signal and the fourth signal, the combiner if further configured to combine the fourth signal and the fifth signal to a sixth signal.

18. The system of claim 16, wherein the first signal and the second signal are a first pair, and wherein the third signal and the fourth signal are a second pair, wherein the combiner is further configured to selectively combine the first pair prior to combining the second pair based at least in part on differing energy characteristics between the first pair and the second pair.

19. The system of claim 15, wherein the combining includes a technique of a group of techniques consisting of: maximum ratio combining, interference rejection combining, and selection combining.

20. The system of claim 15, wherein the first antenna and the second antenna are equidistant from each other, and wherein a third antenna and a fourth antenna within the computing device are equidistant from each other.

* * * * *